US012195249B2

(12) United States Patent
Defert

(10) Patent No.: US 12,195,249 B2
(45) Date of Patent: Jan. 14, 2025

(54) CAP FOR CLOSING A RECEPTACLE AND AN ASSEMBLY COMPRISING SAID CAP

(71) Applicant: ALBEA SERVICES, Gennevilliers (FR)

(72) Inventor: Sylvain Defert, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 299 days.

(21) Appl. No.: 17/630,256

(22) PCT Filed: Jul. 7, 2020

(86) PCT No.: PCT/EP2020/069157
§ 371 (c)(1),
(2) Date: Jan. 26, 2022

(87) PCT Pub. No.: WO2021/018528
PCT Pub. Date: Feb. 4, 2021

(65) Prior Publication Data

US 2022/0289439 A1 Sep. 15, 2022

(30) Foreign Application Priority Data

Jul. 26, 2019 (FR) ..... 1908546

(51) Int. Cl.
*B65D 51/22* (2006.01)

(52) U.S. Cl.
CPC .... *B65D 51/222* (2013.01); *B65D 2251/0028* (2013.01); *B65D 2251/0093* (2013.01)

(58) Field of Classification Search
CPC ..... B65D 51/222; B65D 2251/0028; B65D 2251/0093; B65D 51/223
USPC ..... 220/278
See application file for complete search history.

(56) References Cited

U.S. PATENT DOCUMENTS

| | | | | | |
|---|---|---|---|---|---|
| 4,742,929 | A * | 5/1988 | Desai | B65D 41/04 | 215/332 |
| 5,938,055 | A * | 8/1999 | Philips | B65D 41/06 | 215/230 |
| 2003/0024947 | A1* | 2/2003 | Joshi | B65D 51/225 | 222/83 |
| 2017/0297788 | A1* | 10/2017 | Defert | B65D 41/02 | |

FOREIGN PATENT DOCUMENTS

| | | | |
|---|---|---|---|
| CN | 86204228 | U | 3/1987 |
| EP | 3260388 | A1 | 12/2017 |
| WO | 2007022653 | A1 | 3/2007 |
| WO | 2015014553 | A1 | 2/2015 |

* cited by examiner

*Primary Examiner* — James N Smalley
(74) *Attorney, Agent, or Firm* — Kilpatrick Townsend & Stockton LLP

(57) ABSTRACT

A plug configured to close a receptacle comprising a neck, the plug comprising: —an upper wall and a peripheral wall extending transverse to said upper wall; —at least one projecting element configured to engage with a groove located on the neck so that the plug transitions from a first position to a second position; —at least one opening located on the peripheral wall of the plug, the one or more openings being in line with the projecting elements of the plug.

9 Claims, 7 Drawing Sheets

[Fig. 1]
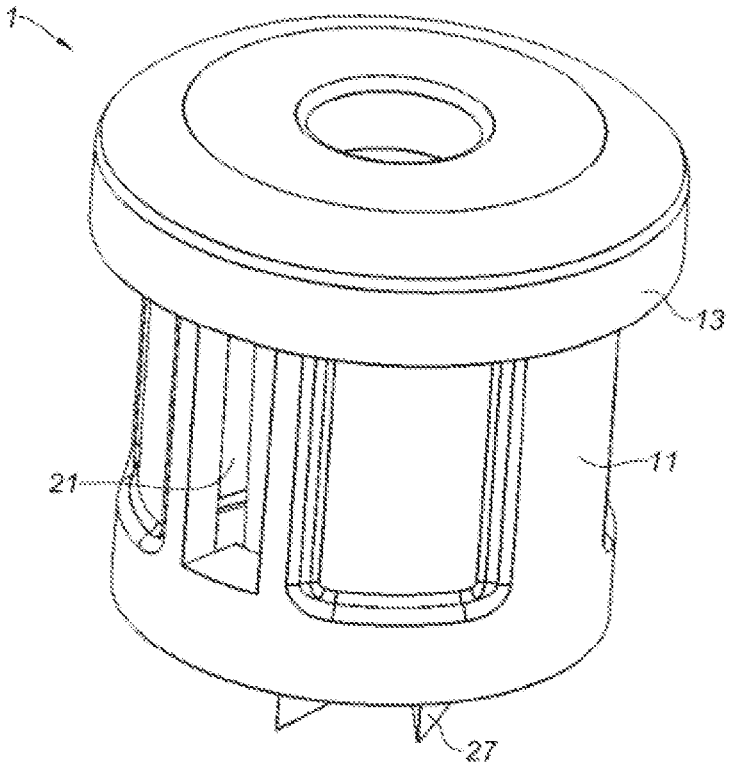

[Fig. 2]
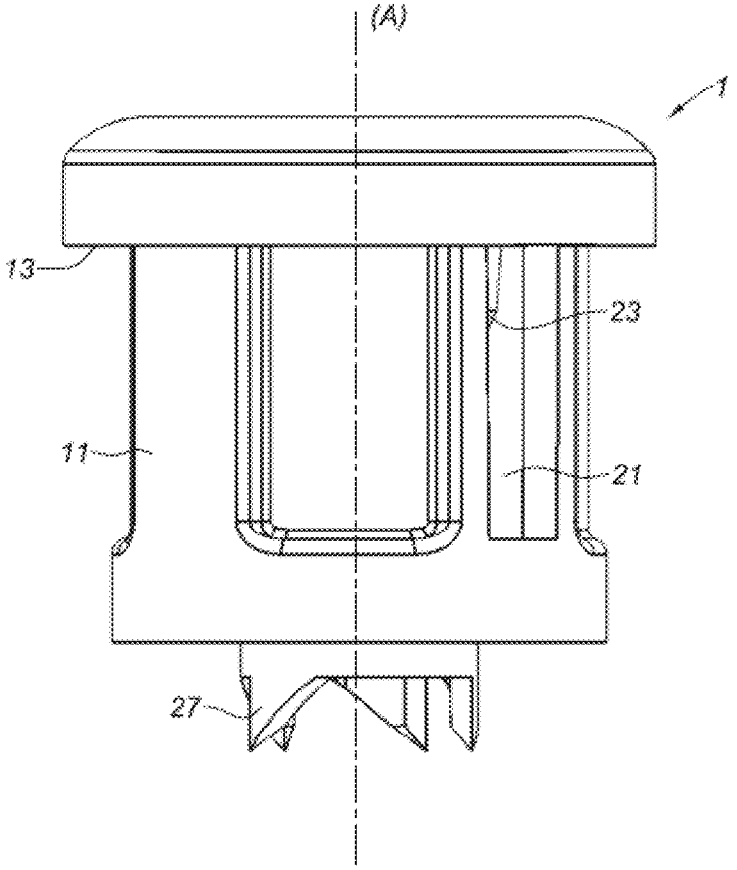

[Fig. 3]
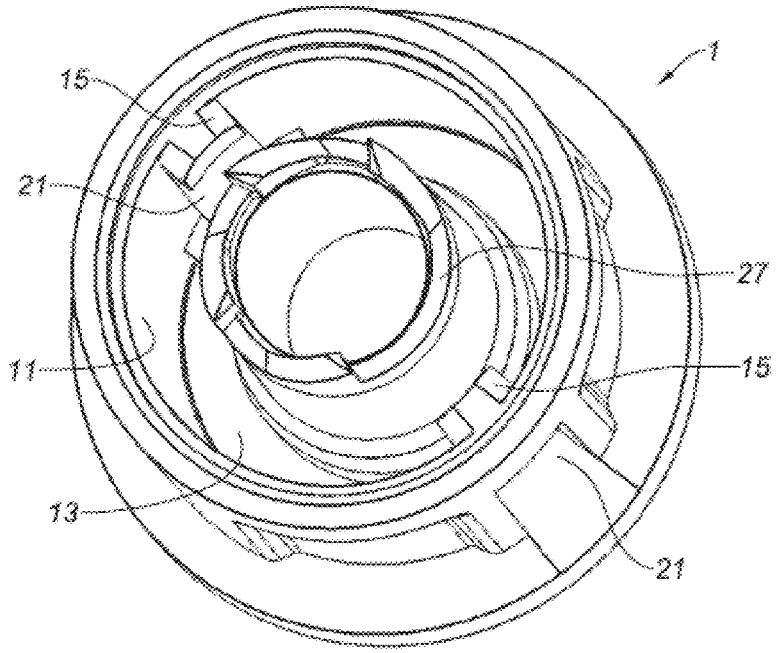

[Fig. 4]
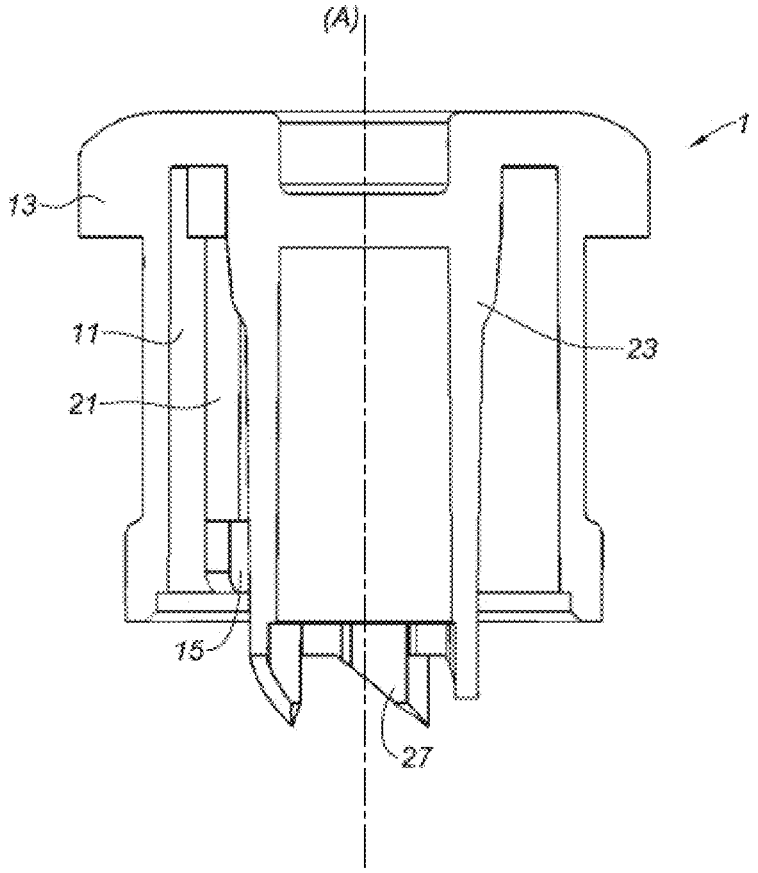

[Fig. 5]
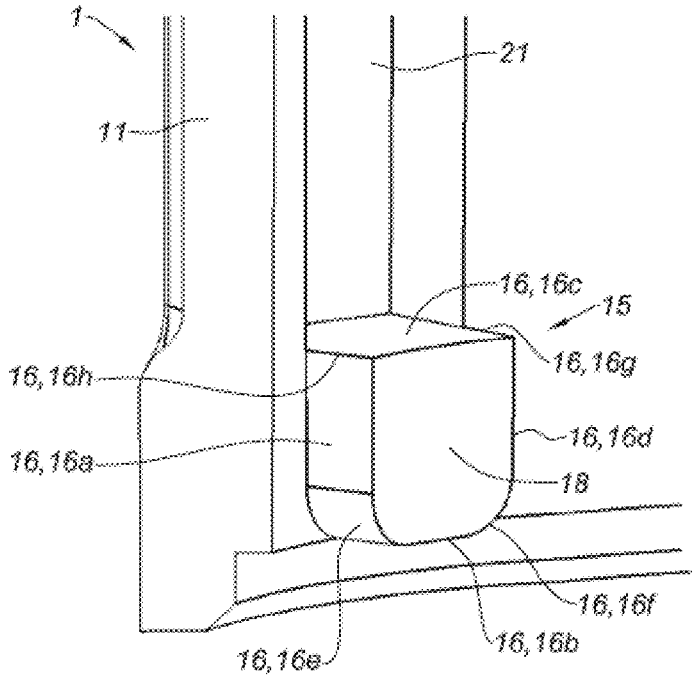
[Fig. 6]
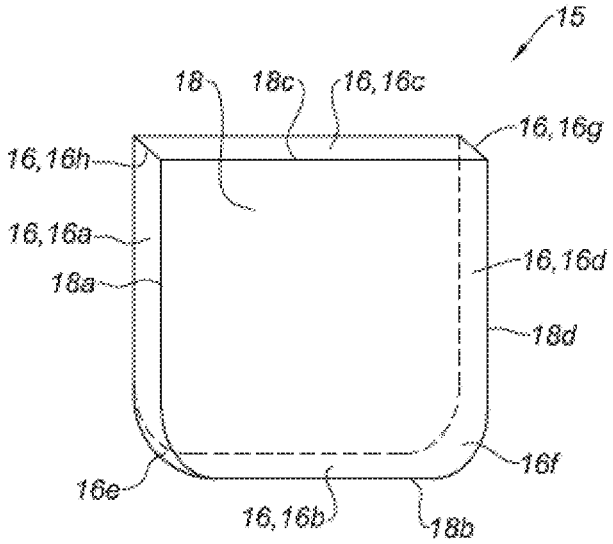

[Fig. 7]
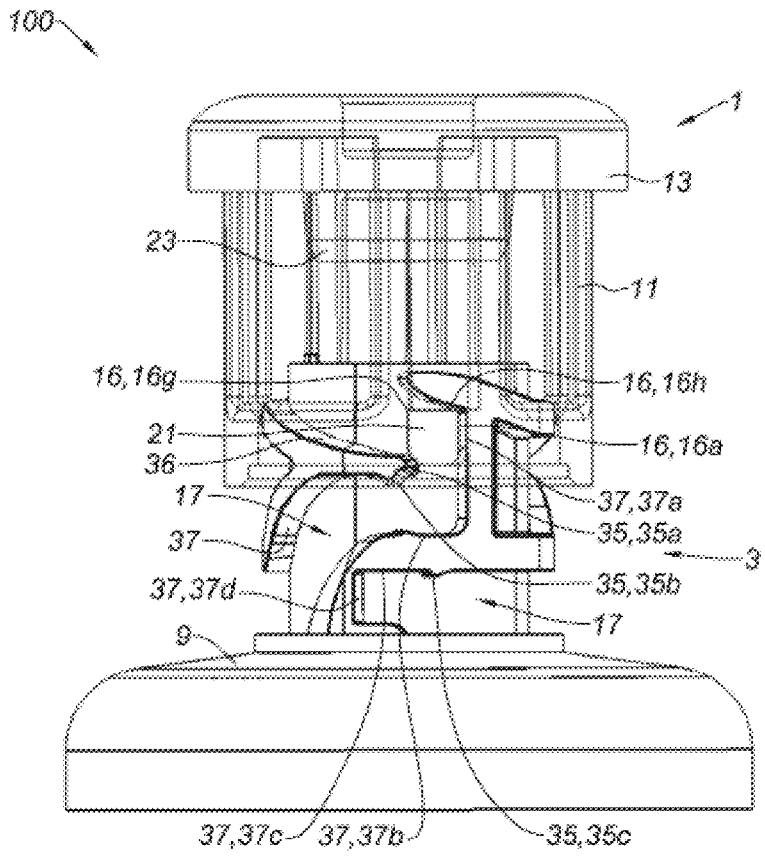

[Fig. 8]
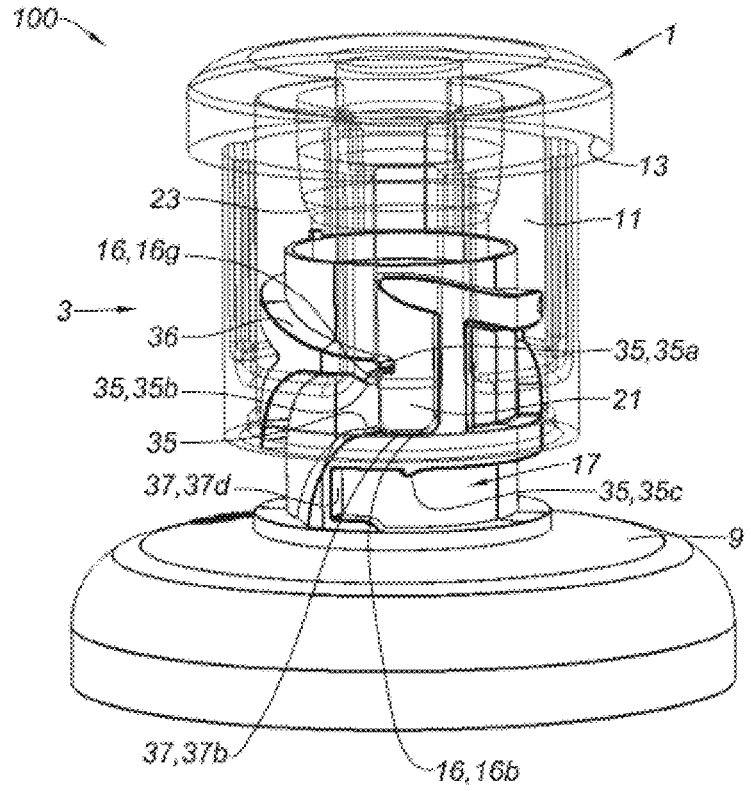
[Fig. 9]
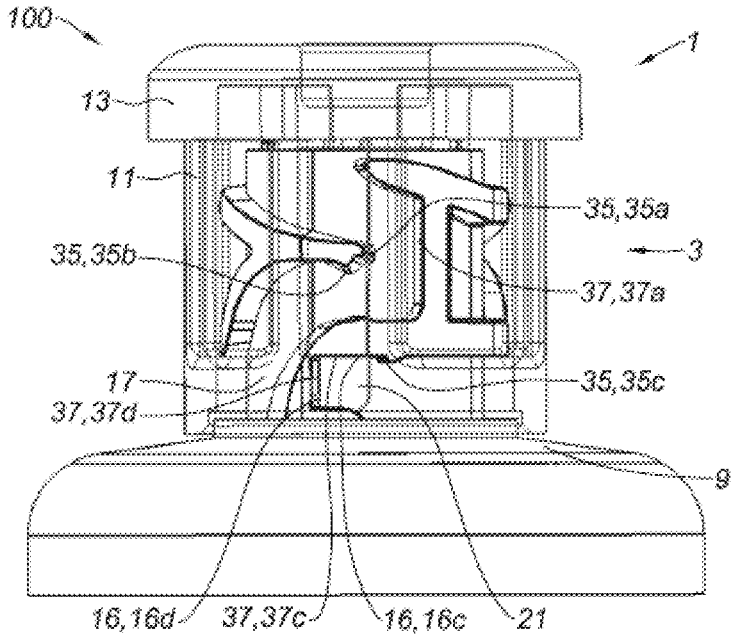

CAP FOR CLOSING A RECEPTACLE AND AN ASSEMBLY COMPRISING SAID CAP

The present invention relates to the field of caps for receptacle.

Classically, the caps are attached on the opening of a receptacle, such as a neck, by screwing. The cap and the neck are then provided with complementary screw threads that cooperate with each other. When the user wants to close or open the receptacle, he/she performs a screwing or unscrewing movement in one direction or the other. The cap is also provided with a sealing element allowing to reinforce the closure.

However, obtaining caps with a screw thread has disadvantages, in particular in terms of demoulding the cap.

There are also caps where the screw threads are replaced by one or more projecting elements with a circular profile that cooperate with a groove located on the neck. The projecting element or the projecting elements of the cap may be obtained by moulding. A portion of the mould bearing the impression of a first portion of the cap comes from the top and another portion bearing the impression of the rest of the cap comes from the bottom. For this type of moulding, the cap has an opening on its upper wall in line with the projecting elements.

In this configuration, the arrangement of the sealing element is limited by the presence of the openings on its upper wall. Indeed, to ensure a seal with the receptacle for such a cap despite the openings, it is necessary to position the sealing element so that the delivered product does not pass through said openings in the upper wall. Furthermore, such an arrangement of openings is incompatible with certain caps such as for example flip top type caps.

To overcome this first disadvantage, the present invention proposes, according to a first aspect, a cap configured to close a receptacle comprising a neck, said cap comprising:

- an upper wall and a peripheral wall extending transversely to said upper wall,
- at least one projecting element configured to cooperate with a groove located on said neck so that the cap moves from a first position to a second position,
- at least one opening located on the peripheral wall of said cap, said opening or said openings being in line with the projecting elements of said cap.

According to this first aspect of the invention, the presence of at least one opening on the peripheral wall of the cap allows to facilitate a moulding/unmoulding compared with a cap having a screw thread and compared with a cap having openings on its upper wall. In addition, this configuration allows a greater freedom of positioning of the sealing element and is in particular compatible with a flip top type cap.

According to this first aspect, the invention may also comprise any of the following characteristics, taken individually or in any technically possible combination:

- the cap comprises a sealing element configured to provide a seal between the cap and the neck,
- the sealing element is radially offset from said projecting element,
- said projecting element or said projecting elements are located on an internal surface of the peripheral wall of said cap,
- said groove or said grooves of the neck extend over an external surface of said neck,
- the sealing element is located radially away from said openings of said cap to seal said receptacle,

- the sealing element is located on an internal surface of the upper wall of said cap,
- the number of projecting elements of said cap and the number of openings of said cap are identical,
- the number of projecting elements of said cap and the number of grooves of said neck are identical,
- said projecting element or said projecting elements of said cap are located on a lower portion of said cap,
- said opening or said openings of said cap are evenly distributed on the peripheral wall of said cap,
- said projecting element or said projecting elements of said cap are evenly distributed over the peripheral wall of said cap,
- the cap extends along a longitudinal axis (A), said opening or said openings of said cap extending along said longitudinal axis (A),
- said projecting element or said projecting elements have a substantially square profile,
- the sealing element is a sealing snap ring formed by an excess thickness of material on the internal surface of the upper wall of said cap,
- the sealing snap ring is configured to cooperate with a snap ring seat provided on an inner surface at the upper end of said neck when said cap is in its second position,
- said cap further comprises a punch adapted to cut and/or pierce a lid closing an internal end of the neck opening into an inner volume of the receptacle,
- the punch has a barrel shape whose upper end is open so as to be able to communicate with an external volume of the receptacle when said cap is in its second position,
- the cap comprises a cover hinged at the level of the upper wall of said cap, said cover being movable between an open position and a closed position so as to be able to respectively allow and prevent access to the external volume of the receptacle,
- the cap is configured so that the punch is held away from said lid in a standby position.

Another disadvantage of the caps with projecting elements with a circular profile cooperating with a groove located on the neck is the bearing surface of said projecting element against said groove. Indeed, with a circular projecting element, only a small surface area of the projecting element is effectively abutted against the groove. The guiding is therefore not optimal. In addition, when held in the standby position by stops, a circular projecting element generates only little constraints against the stops and thus risks unintentionally of exceeding the standby position.

To overcome this other disadvantage, the present invention proposes, according to a second aspect, a cap configured to close a receptacle comprising a neck, said cap comprising at least one projecting element configured to cooperate with a groove located on said neck so that the cap moves from a first position to a second position, said projecting element having a peripheral face comprising a first and a second side portions, a lower portion and an upper portion, at least one of said portions being substantially flat.

According to this second aspect of the invention, the presence of a projecting element having at least one portion of its flat peripheral face allows to generate a larger bearing area and thus to improve the guiding of said projecting element in the groove of the neck. In addition, or alternatively, such a projecting element allows to generate greater constraints during the passage of holding stop in standby position and thus reduces the risks of unintentionally exceeding the standby position.

According to this second aspect, the invention may also comprise any of the following characteristics, taken individually or in any technically possible combination:

- the first side portion provided in an opening direction of the cap, of the peripheral face of the projecting element, is flat,
- the lower portion of the peripheral face of the projecting element is flat,
- the upper portion of the peripheral face of the projecting element is flat,
- the second side portion provided in the closing direction of the cap, of the peripheral face of the projecting element, is flat,
- the lower portion and the first side portion of the peripheral face define between them a first rounding, the lower portion and the second side portion of the peripheral face defining between them a second rounding,
- the upper portion and the second side portion of the peripheral face define a first edge between them,
- the upper portion and the first side portion of the peripheral face define a second edge between them,
- the projecting element comprises a distal face that is slightly concave so as to conform to the external surface of the neck,
- the first side portion of the peripheral face and the distal face of the projecting element define a third edge between them,
- the lower portion of the peripheral face and the distal ace of the projecting element define a fourth edge between them,
- the upper portion of the peripheral face and the distal face of the projecting element define a fifth edge between them,
- the second side portion of the peripheral face and the distal face of the projecting element define a sixth edge between them,
- said projecting element or said projecting elements of said cap are located on the lower portion of said cap,
- said cap comprises at least one opening located on a wall of said cap, said opening or said openings being in line with the projecting elements of said cap,
- said opening or said openings of said cap are evenly distributed over the peripheral wall of said cap,
- the cap also comprises a punch adapted to cut and/or pierce a lid closing an internal end of the neck opening into an inner volume of the receptacle,
- the cap is configured so that the punch is held away from said lid in a standby position,
- the cap comprises a sealing element configured to provide a seal between the cap and the neck,
- the sealing element is radially offset from said projecting element,
- the sealing element is located on an internal surface of an upper wall of said cap,
- said projecting element or said projecting elements are located on an internal surface of the peripheral wall of said cap,
- said groove or said grooves of the neck extend over an external surface of said neck,
- said sealing element is located radially away from said openings of said cap to ensure the sealing of said receptacle,
- the number of projecting elements of said cap, the number of openings of said cap and the number of grooves of said neck are identical,
- said projecting element or said projecting elements of said cap are evenly distributed around the circumference of the internal surface of said cap,
- said projecting element or said projecting elements of said cap is configured to cooperate with at least one projecting element of said groove or said grooves of the neck to maintain said cap in a standby position and/or in a closed position.

The invention also relates to an assembly for closing a receptacle, said assembly comprising a neck and a cap as described above.

Further characteristics, purposes and advantages of the invention will be apparent from the following description, which is purely illustrative and non-limiting, and which should be read in conjunction with the appended drawings, in which:

FIG. 1 is a perspective view of a cap according to an embodiment of the invention, from a view angle illustrating the exterior of the cap, FIG. 2 is an elevation view of the cap according to FIG. 1, FIG. 3 is a perspective view of a cap according to FIG. 1, from a view angle illustrating the interior of the cap, FIG. 4 is a cross-sectional view of a cap according to FIG. 1, according to a diametrical cutting plane, FIG. 5 is an elevation view of a portion of the cap according to the invention, FIG. 6 is a schematic representation of a projecting element of a cap according to the invention, FIG. 7 is an elevation view with transparency of a closure assembly according to the invention in the open position, FIG. 8 is an elevation view with transparency of a closure assembly according to the invention in the standby position, FIG. 9 is a transparent elevation view of a closure assembly according to the invention in the closed position.

As illustrated in FIGS. 1 to 9, the invention relates to a cap 1 configured for closing a receptacle comprising a neck 3. Said cap 1 is thus designed to be attached to said neck 3 to close said receptacle and form an assembly comprising the neck 3 and said cap 1.

In the examples illustrated herein, the receptacle is a tube comprising a tube head provided with said neck 3 and a shoulder 9.

In a general manner, said cap 1 comprises an upper wall 13 and a peripheral wall 11 extending transversely to said upper wall 13. As illustrated in FIGS. 2 and 4, the cap 1 extends along a longitudinal axis (A) passing through its centre. Said peripheral wall 11 here extends perpendicular to said upper wall 13, for example slightly away from a periphery of said upper wall 13.

According to the invention, the cap 1, in particular the internal surface of its peripheral wall 11 is free of screw threads. On the other hand, said cap 1 comprises at least one projecting element 15. Said projecting element or said projecting elements 15 are configured to cooperate with a guiding groove 17 located on the neck 3 so that the cap 1 moves from a first position, referred to as open position, to a second position, referred to as closed position.

Said cap 1 comprises at least one opening 21 located on the peripheral wall 11 of said cap 1. As can be seen in particular in FIGS. 3, 4 and 5, the opening or the openings 21 are in line with the projecting elements 15 of said cap 1.

The openings 21 correspond to the passage of a broach-shaped area of a portion of the mould used to obtain said projecting elements 15, in particular an upper portion of said protrusion 15. The presence of at least one opening 21 on the peripheral wall 11 of the cap 1 allows to facilitate a moulding/unmoulding compared with a cap having a screw thread and compared with a cap having openings on its upper wall, avoiding an unmoulding by unscrewing or a forceful unmoulding. In addition, this configuration allows a greater freedom of positioning of the sealing element and is in particular compatible with a flip top type cap.

Advantageously, the cap 1 comprises a sealing element 23 configured to provide a seal between the cap 1 and the neck 3. When projected onto a plane orthogonal to the axis (A), said sealing element 23 is radially offset from said projecting element 15.

Advantageously still, said sealing element 23 is located on an internal surface of the upper wall 13 of said cap 1.

Preferably, the sealing element 23 is located radially away from the openings 21 of said cap 1 to ensure the sealing of said receptacle.

Said sealing element 23 may have different configurations depending on the neck with which the cap 1 according to the invention is associated. Advantageously, the sealing element 23 is a sealing snap ring formed by an excess thickness of material on the internal surface of the upper wall 13 of said cap 1. Said snap ring may in particular comprise a deformable lip. Said sealing snap ring 23 is then configured to cooperate with a snap ring seat provided on an inner surface at the upper end of said neck 3 when said cap 1 is in its second position. Thus, when the cap is in its second position, said snap ring 23 is compressed on the snap ring seat.

Advantageously, the cap 1 comprises a punch 27 adapted to cut and/or pierce a lid closing an internal end of the neck 3 opening into an inner volume of the receptacle. Said punch 27 is in particular derived from matter of said cap 1. Said punch 27 is configured to be inserted inside the neck 3 of the tube head 7 when the cap 1 is attached to said neck 3.

Advantageously still, the punch 27 has a barrel shape, the upper end of which is open so as to be able to communicate with an external volume of the receptacle when said cap 1 is in its second position.

According to an embodiment not shown, the punch 27 has a barrel shape configured to cooperate with an internal wall of the neck 3 when the cap 1 is in its second position. The external wall of the barrel is then in contact with the internal wall of the neck 3 so as to ensure that the receptacle is sealed. In this embodiment, the cap 1 is thus devoid of sealing element 23.

Advantageously, the number of projecting elements 15 of said cap 1 and the number of openings 21 of said cap 1 are identical. In the embodiments shown here, the cap 1 comprises two projecting elements 15 and two openings 21, in particular diametrically opposed.

Advantageously still, the number of grooves 17 for guiding the neck 3 with which the cap 1 is associated and the number of projecting elements 15 of said cap are identical.

The projecting elements 15 of the cap 1 according to the invention may have different configurations. Preferably, said projecting element or said projecting elements 15 of the cap 1 are located on a lower portion of said cap 1.

Advantageously, said projecting element or said projecting elements 15 of said cap 1 are evenly distributed on the peripheral wall 11 of said cap 1. Advantageously still, said projecting element or said projecting elements 15 are located on an internal surface of the peripheral wall 11 of said cap 1. Preferably, said opening or said openings 21 of said cap 1 are also evenly distributed on the peripheral wall 11 of said cap 1. Said groove or said grooves 17 of the neck then extend over an external surface of said neck 3.

Advantageously, in order to allow the cap 1 to move from an open position to a closed position and vice versa, said groove 17 has successive guiding portions. It may in particular be a first portion ensuring the engagement of the corresponding projecting element 15 in said groove 17 and/or the holding of said cap 1 in a standby position (FIG. 8) and other successive portions allowing the passage from the standby position to the closed position (FIG. 9) and vice versa.

In the embodiment shown in FIGS. 7 to 9, the two grooves 17 each have a first portion vertical with respect to the axis (A). This first portion allows in particular the engagement of said cap 1 in the groove 17 but also its passage from the open position to the standby position, in particular when the cap 1 comprises the punch 27. This first portion is followed by a second helical portion. This second portion allows the passage of said cap 1 from the standby position to the closed position and vice versa. Said groove 17 finally ends in a last portion that is horizontal with respect to the axis Z-Z. When the projecting elements 15 of said cap have reached this last portion, the cap 1 is in the closed position (FIG. 9) and the receptacle is sealed.

In this embodiment, said neck 3 advantageously comprises a guiding ramp 36 as can be seen in FIGS. 7 to 9. Said guiding ramp 36 is configured to cooperate with at least one projecting element 15 of said cap 1 to position one of said projecting elements 15 at the entrance of said groove 17, the cap 1 being then in an open position. The guiding ramp 36 allows to guide one of the projecting elements 15 of the cap 1 into the first portion of the guide groove 17. Said guiding ramp 36 is visible in FIGS. 7 to 9.

Advantageously, said guiding ramp 36 has a guiding direction opposite to the guiding direction of said groove 17 for the passage of said cap 1 from the standby position to the closed position. Thus, in order to position one of said projecting elements 15 of said cap 1 in the entrance of said groove 17, it is necessary to make a rotational movement in one direction. This rotational movement is usually carried out by a machine in an automated way. Then, once said cap 1 has been placed in a standby position, it is necessary to make a rotational movement in an opposite direction, generally in the conventional direction of rotation for closing a cap 1 which is most often clockwise, in order to take the cap 1 out of the standby position and to initiate the closing of said cap 1 and/or the cutting and/or the perforation of said lid by the punch 27. This double direction of rotation allows to prevent the machine, when placing a cap 1 provided with a punch 27 in the standby position, from rotating too much and initiating a position of use in which the lid is cut and/or perforated and the punch 27 damages the lid before the receptacle is used.

Advantageously, said ramp 36 may also comprise a stop for forcing one of said projecting elements 15 of the cap 1 to stop at the level of the entrance of the groove 17. Here, the stop is a portion 37*a* of a sidewall 37 of the groove 17.

As mentioned above, the cap 1 extends along a longitudinal axis (A). Advantageously, said opening or said openings 21 of the cap 1 extend along said longitudinal axis (A). In other words, said opening or said openings are substantially elongated along the longitudinal axis (A). This elongated shape can be seen in FIGS. 1, 2 and 4.

The projecting elements 15 of the cap 1 may have different shapes, in particular a pin shape. Advantageously, the projecting element or the projecting elements 15 of the cap 1 have a substantially square profile. In other words, the projecting element 15 has a substantially square cross-section with rounded or unrounded corners. The section considered here is the section in a plane orthogonal to the radius of the cap 1. This aspect of the invention will be discussed in more detail later.

According to another embodiment not shown in the figures, the cap 1 comprises a hinged cover at the level of the upper wall 13 of said cap 1. The cover is movable between an open and a closed position so as to allow and prevent access to the internal volume of the receptacle respectively.

Advantageously, the cap 1 is configured to be immobilized on the neck 3 while the punch 27 is held away from said lid, this in a position referred to as standby position. The cap 1 in the standby position on the neck 3 is shown in FIG. 8.

According to a second aspect of the invention, said projecting element 15 has a peripheral face 16 comprising a first and a second side portions 16*a*, 16*d*, a lower portion 16*b* and an upper segment 16*c*. At least one of said portions is substantially flat. The various faces and portions of the projecting element 15 are shown in FIG. 6. Said first and second side portions connect said lower and upper portions.

The presence of a projecting element 15 having at least one portion of its flat peripheral face allows to generate a larger support area against the neck 3 with which the cap 1 is associated. This improves the guiding of the projecting element 15 in the groove of the neck 3.

In practice, as already mentioned, said projecting element or pin 15 has a substantially square cross-section with rounded or unrounded corners.

Advantageously, when the cap 1 is mounted on the neck 3, said cap 1 passes from a first position, referred to as the open position, represented in FIG. 7 to a standby position represented in FIG. 8, then from said standby position to a second position, referred to as the closed position, represented in FIG. 9. When the cap 1 moves from one position to the other, it performs a rotational movement and a translational movement along the longitudinal axis (A).

In the embodiment shown in FIGS. 7 to 9, when the cap 1 is mounted on the neck 3, said cap 1 is first rotated counter clockwise along the longitudinal axis (A) so that one of said projecting elements 15 is positioned at the entrance of said groove 17. The cap 1 is now in the open position. When the cap 1 moves from the open position to the standby position, it undergoes a translation along the longitudinal axis (A) in the direction of the neck 3.

When the cap 1 moves from the standby position to the second position, the cap performs, among other things, a rotational movement along the longitudinal axis (A) in a rotational direction referred to as the closing direction of the cap. When the cap 1 moves from the second position to the standby position, the cap performs, among other things, a rotational movement along the longitudinal axis (A) in a rotational direction referred to as the opening direction of the cap.

According to the embodiment shown in FIGS. 7 to 9, the closing direction of the cap corresponds to a clockwise rotation and the opening direction of the cap corresponds to a counter clockwise rotation. However, the invention is not limited to the embodiment shown in these figures or to these directions of rotation.

Advantageously, the first side portion 16*a* provided in an opening direction of the cap 1, of the peripheral face 16 of the projecting element 15, is flat. As illustrated in FIG. 7, when the cap is in the first position, the first side portion 16*a* comes into contact of a first portion 37*a* of the sidewall 37 of the groove 17 of the neck 3. The fact that the first side portion 16*a* is flat allows for a better support against said sidewall 37 of said groove 17. Said cap 1 is in this first position when the cap 1 is placed on the neck 3. This placing, also referred to as capping, is particularly carried out on production lines. A good support of the projecting element against the sidewall 37 of the groove allows to limit the production incidents.

As illustrated in FIG. 8, when the cap 1 is in the standby position on the neck 3, the punch 27 is held away from the lid. Said cap 1 is in this standby position at the end of a movement for placing the cap 1 on the neck 3. It is in this position that the assembly 100 is sold before filling the receptacle. It is also in this standby position that the assembly 100 is sold to the consumer, after filling the receptacle.

Advantageously, the lower portion 16*b* of the peripheral face 16 of the projecting element 15 is also flat. As illustrated in FIG. 8, when the cap 1 is in the standby position, the lower portion 16*b* comes into contact with a second portion 37*b* of the sidewall 37 of the groove 17 of the neck 3. The fact that the lower portion 16*b* is flat allows a better support against the sidewall 37 of said groove 17 and a better locking in standby position.

As illustrated in FIG. 9, when the cap 1 is in the closed position, said punch 27 has pierced said lid. The cap 1 then hermetically seals the receptacle on which an assembly 100 is adapted. The closed position may also be referred to as the position of use in that the cutting of the lid determines the starting point of use of the receptacle 100 on which the closure assembly 100 according to the invention is mounted. The cap 1 may be intended to be returned to its first position so that it can be removed from the neck. The cap 1 may also be intended to remain in the closed position. This is in particular the case, according to the embodiment already mentioned, when the punch 27 has the shape of a hollow barrel and has an opening at the level of the upper face of the cap 1. Thus, once the cap 1 is in the closed position on the neck 3, the access to the internal volume of the receptacle on which the assembly 100 is adapted is possible through said opening.

Advantageously, the upper portion 16*c* of the peripheral face 16 of the projecting element 15 is also flat. As illustrated in FIG. 9, when the cap 1 is in the closed position, the upper portion 16*c* comes into contact with a third portion 37*c* of the sidewall 37 of the groove 17 of the neck 3. The fact that the upper portion 16*c* is flat allows a better support against the sidewall 37 of said groove 17 and a better locking in the closed position.

Advantageously, the second side portion 16*d* provided in the closing direction of the cap 1, of the peripheral face 16 of the projecting element 15, is also flat. As illustrated in FIG. 9, when the cap 1 is in the closed position, the second side portion 16*d* comes into contact with a terminal portion 37*d* of the sidewall 37 of the groove 17 of the neck 3. The fact that the second side portion 16*d* is flat allows a better support against the sidewall 37 of said groove 17 and a better locking in the closed position.

According to an embodiment shown in FIGS. 7 to 9, said groove or said grooves 17 of the neck 3 comprise at least one protrusion 35 configured to cooperate with at least one of the projecting elements 15 of said cap 1 to hold said cap 1 in a standby position and/or in a closed position. Preferably, the neck comprises a first and a second protrusion 35*a*, 35*b* allowing the cap to be held in standby position and at least a third protrusion 35*c* allowing the cap to be held in a closed position.

Advantageously, the lower portion 16*b* and the first side portion 16*a* of the peripheral face 16 define between them a first rounding 16*e*. Advantageously still, the lower portion 16*b* and the second side portion 16*d* of the peripheral face 16 define between them a second rounding 16*f*. The presence of a first and/or a second rounding allows to guide the projecting element 15 along the groove 17, against the lower sidewall 37 of said groove 17, in particular when passing the first protrusion 35*a*. In particular, the presence of a rounding allows to reduce the constraints applied by the projecting element 15 against the groove 17.

Advantageously, as shown in FIG. 6, the upper portion 16*c* and the second side portion 16*d* of the peripheral face 16 define between them a first edge 16*g*. The presence of this first edge 16*g* allows to generate a clear stop when the cap is in the standby position, this between the projecting element 15 and the protrusion 35*b*. Such a contact allows to securely hold the cap in the standby position.

Advantageously still, the upper portion 16*c* and the first side portion 16*a* of the peripheral face 16 define between them a second edge 16*h*. The presence of this second edge 16*h* allows to generate a clear stop when the cap is in the closed position, this between the projecting element 15 and the protrusion 35*c*. Such a contact allows to securely hold the cap in the closed position.

Preferably, the projecting element 15 comprises a distal face 18 that is slightly concave so as to conform to the external surface of the neck 3. This concave shape allows to reduce the overall dimension and improves the support of the pin 15 against the neck 3. Said distal face 18 is bordered by said flat portions 16*a*, 16*b*, 16*c* and 16*d*.

Advantageously, the first side portion 16*a* of the peripheral face 16 and the distal face 18 of the projecting element 15 define between them a third edge 18*a*. Advantageously still, the lower portion 16*b* of the peripheral face 16 and the distal face 18 of the projecting element 15 define a fourth edge 18*b* between them. Preferably, the upper portion 16*c* of the peripheral face 16 and the distal face 18 of the projecting element 15 define a fifth edge 18*c* between them. Even more preferably, the second side portion 16*d* of the peripheral face 16 and the distal face 18 of the projecting element 15 define a sixth edge 18*d* between them.

The presence of edges on the pin 15 allows to generate constraints and to secure the different positions of the cap 1 on the neck 3.

As illustrated in FIGS. 7 to 9, the present invention also relates to an assembly 100 comprising a neck 3 and a cap 1 as described above.

The invention claimed is:

1. A cap configured to close a receptacle comprising a neck, said cap comprising:

an upper wall and a peripheral wall extending transversely to said upper wall, at least one projecting element configured to cooperate with a groove located on said neck so that the cap moves from a first position to a second position, at least one opening located on the peripheral wall of said cap, each of the at least one opening being in line with respective projecting element of the at least one projecting element of said cap and extending only on the peripheral wall and not opening onto the upper wall, and a punch adapted to cut and/or pierce a lid closing an internal end of the neck opening into an inner volume of the receptacle.

2. The cap according to claim 1, wherein a number of projecting elements of said cap and a number of openings of said cap are identical.

3. The cap according to claim 1, wherein said projecting element or said projecting elements of said cap are located on a lower portion of said cap.

4. The cap according to claim 1, wherein said projecting element or said projecting elements of said cap are evenly distributed on the peripheral wall of said cap.

5. The cap according to claim 1, wherein the cap extends along a longitudinal axis (A), said opening or said openings of said cap extending along said longitudinal axis (A).

6. The cap according to claim 1, wherein said projecting element or said projecting elements have a substantially square profile.

7. The cap according to claim 1, wherein the punch has a barrel shape whose upper end is open so as to be able to communicate with an external volume of the receptacle when said cap is in its second position.

8. The cap according to claim 1, wherein said cap is configured so that the punch is held away from said lid in a standby position.

9. An assembly for closing a receptacle, said assembly comprising a neck and a cap according to claim 1.

* * * * *